US008505347B2

(12) United States Patent
Piotrowski et al.

(10) Patent No.: US 8,505,347 B2
(45) Date of Patent: Aug. 13, 2013

(54) LOCKING DEVICE WITH ASSOCIATED KEY AND BLOCKING RIB SENSING

(75) Inventors: Theo Piotrowski, Kerpen (DE); Michael Reine, Essen (DE)

(73) Assignee: C. Ed. Schulte Gesellschaft Mit Beschraenkter Haftung Zylinderschlossfabrik, Velbert (DE)

( * ) Notice: Subject to any disclaimer, the term of this patent is extended or adjusted under 35 U.S.C. 154(b) by 281 days.

(21) Appl. No.: 12/879,343

(22) Filed: Sep. 10, 2010

(65) Prior Publication Data

US 2011/0083484 A1 Apr. 14, 2011

(30) Foreign Application Priority Data

Oct. 8, 2009 (DE) ..... 10 2009 044 207

(51) Int. Cl.
*E05B 9/04* (2006.01)

(52) U.S. Cl.
USPC ..... 70/373; 70/358; 70/493; 70/495; 70/377

(58) Field of Classification Search
USPC ..... 70/356, 358, 492, 493, 369, 376–378, 70/373, 494–496
See application file for complete search history.

(56) References Cited

U.S. PATENT DOCUMENTS

| | | | | |
|---|---|---|---|---|
| 4,325,242 | A * | 4/1982 | Tietz | 70/401 |
| 5,475,998 | A * | 12/1995 | Raskevicius et al. | 70/495 |
| 5,819,567 | A * | 10/1998 | Eden, Jr. | 70/390 |
| 5,823,030 | A * | 10/1998 | Theriault et al. | 70/419 |
| 6,427,506 | B1 * | 8/2002 | Prunbauer | 70/495 |
| 2005/0274162 | A1 * | 12/2005 | Keller | 70/358 |
| 2006/0042335 | A1 * | 3/2006 | Osada | 70/358 |
| 2011/0079059 | A1 * | 4/2011 | Piotrowski et al. | 70/378 |
| 2012/0118032 | A1 * | 5/2012 | Baumann | 70/373 |

FOREIGN PATENT DOCUMENTS

| | | |
|---|---|---|
| DE | 198 38 000 | 2/2000 |
| EP | 0851079 | 7/1998 |
| WO | 00/22262 | 4/2000 |

* cited by examiner

*Primary Examiner* — Suzanne Barrett
(74) *Attorney, Agent, or Firm* — Lucas & Mercanti, LLP; Klaus P. Stoffel

(57) ABSTRACT

A locking device which has a lock cylinder and a matching key. The key has a key bit with at least one coding notch and a blocking rib with at least one indentation. The lock cylinder has a housing with a bearing bore and a cylinder core that is mounted in the bearing bore and a blocking member. The blocking member is engagable in a blocking recess of the bearing bore and prevents rotation of the cylinder core. A pivot lever is mounted in the cylinder core and has a bearing end about which the pivot lever pivots, and a sensing end which senses the blocking rib The pivot lever closes off a capturing opening for the housing pin when the blocking rib is the proper height and opens the capturing opening after a partial rotation of the cylinder core when the blocking rib is missing.

7 Claims, 4 Drawing Sheets

LOCKING DEVICE WITH ASSOCIATED KEY AND BLOCKING RIB SENSING

CROSS REFERENCE TO RELATED APPLICATIONS

This application claims the benefit of German application DE 102009044207.3-15 filed Oct. 8, 2009 which is incorporated by reference herein.

BACKGROUND OF INVENTION

The invention relates to a locking device having a lock cylinder and a matching key; the key having a key bit with at least one coding notch cut in, in particular on the front, and a blocking rib that runs in the direction of extent of the key bit and has at least one blocking rib indentation; the lock cylinder having a housing with a bearing bore and a cylinder core that is mounted in the bearing bore and has a keyway for insertion of a key, the cylinder core being blocked against rotation, when a key is not inserted, by at least one housing pin mounted in a housing hole; the housing pin projecting into a core hole of the cylinder core in which a core pin is fitted, and the housing pin being able to be brought into a release position enabling rotation of the cylinder core by entry of the core pin into the coding notch of the key inserted into the keyway; and the locking device having a blocking member for sensing the blocking rib indentation, the blocking member engaging, when a blocking rib indentation is not present, in a blocking recess of the bearing bore and preventing rotation of the cylinder core.

EP 0 851 079 A1 describes a lock cylinder having a cylinder core into the keyway of which a flat key can be inserted, the key having a blocking rib which can be sensed by an inverted pin. The inverted pin disposed in the cylinder core interacts with a counter-pin disposed in the cylinder housing, so that the cylinder core is blocked against rotation by this blocking device when the height of the rib is less or greater than the proper rib height. The rib is here sensed on its side wall.

WO 2000/022262 describes a lock cylinder and a key that is matched thereto, the key bit of the key having, on one of its two broad sides, a blocking rib, and indentations on the opposite broad side. The indentations are sensed by blocking members. If the indentation is missing, the blocking members block in the event of rotation of the cylinder core. The blocking rib is sensed by a slide. If the blocking rib is missing, the slide can be displaced so that a capturing opening disposed immediately beside the core hole is made available into which a housing pin can enter if there is partial rotation of the cylinder core, so that the cylinder core cannot be rotated further.

DE 198 38 000 A1 describes a locking device of the generic kind having a lock cylinder and a key matched thereto. The key has a multiplicity of coding notches cut in at the front by which core pins mounted in core holes in the cylinder core can be organised in such a way that the interface between housing pin and core pin lies in the sleeve surface of the housing bore. Openings run transversely to the keyway in each of which blocking pins are disposed. These blocking pins sense blocking rib indentations of a blocking rib that extends in the direction of extent of the key bit. If a blocking rib indentation of this kind is not present, a blocking portion of the blocking member then lies in a blocking recess in the housing, so that the cylinder core cannot rotate despite the tumbler pins being correctly positioned. A lock cylinder of this kind can be tampered with by filing down the blocking rib.

It is an object of the invention to improve the security against tampering of a lock cylinder of the generic kind.

SUMMARY OF THE INVENTION

This object is met by the invention specified in the claims.

First and foremost, a pivot lever is provided that is mounted in the cylinder core, offset in the axial direction of the cylinder core relative to the blocking member. This pivot lever has a bearing end about which the pivot lever is pivotable. It has a sensing end which senses the blocking rib in an indentation-free region of the blocking rib. The pivot lever closes off a capturing opening for the housing pin when the blocking rib is the proper height. The capturing opening for the housing pin is opened when the blocking rib is missing or when the blocking rib has been partially ground away, so that the housing pin can be captured there after partial rotation of the cylinder core, this leading to rotation of the cylinder core being blocked. In the case of the blocking rib being missing or being partially ground away, the pivot lever is not held in an occluding position, closing-off the capturing opening. Rather the pivot lever lies with its radially outer peripheral edge displaced with respect to the mouth of the capturing opening, so that after partial rotation of the cylinder core, the housing pin can enter into the capturing opening. The capturing opening thus forms at least one blocking step, which prevents further rotation of the cylinder core. The capturing opening is, according to the invention, disposed circumferentially offset relative to the core pin hole in such a way that the cylinder core has to be turned through at least 90° before the housing pin can enter into the capturing opening. For this, the pivot lever is formed preferably as a C-shaped metal part. One end of a C-limb forms the bearing end, the end of the other C-limb forms the sensing end. The back of the pivot lever that faces away from the C-limbs provides an arcuate recess, which preferably has an arcuate extent. This arcuate recess closes off the capturing opening, when the key inserted into the keyway has a proper blocking rib. If the proper blocking rib is lacking, the arcuate recess is displaced radially inwardly in the direction of the axis of rotation of the cylinder core relative to the capturing opening, so that a capturing recess is formed into which the housing pin can enter. The course of the edge of the arcuate recess thus corresponds to the outward curvature of the end face of the housing pin. The arcuate recess is preferably immediately to the rear of the sensing end, thus remote from the bearing end. The bearing end is preferably located in a bearing recess that is provided by an accommodating chamber in which the pivot lever is mounted. The distance from the bearing end to the sensing end is preferably greater than the radius of the cylinder core. A multiplicity of transverse holes are preferably provided in which blocking members formed as pins may be disposed. Not every transverse hole needs to be provided with a blocking member. The blocking members may be formed by mushroom-headed pins. It is seen as advantageous for the pivot lever to be located in its accommodating chamber in a displacement-free manner. In this way it is ensured that the sensing end can project through a through passageway into the keyway. As a result of the development according to the invention, security against tampering is improved. If the blocking rib is filed off, the pivot lever cannot be pivoted to a sufficient extent, so that the capturing opening cannot be closed off by the arcuate recess. If the cylinder core is rotated by more than 90°, starting from the key withdrawal position, the housing pin is captured in the capturing opening, so that further rotation and optionally also withdrawal of the cylinder core is prevented. The lock cylinder according to the invention may have a multiplicity of accommodating chambers arranged in each case in axial alignment with a housing hole or core hole. The accommodating chambers may be equipped as desired with pivot levers. The accommodating chambers not provided with pivot levers may be fitted with filling members which close off the capturing opening permanently.

BRIEF DESCRIPTION OF THE DRAWINGS

An exemplary embodiment of the invention is explained below with reference to accompanying drawings, in which:

FIG. 7 shows an illustration according to FIG. 3, but with a key having been inserted into the keyway 12 which matches the coding notches 4 but has a filed-away blocking rib 3, and the cylinder core 11 having been rotated as far as a capturing position.

BRIEF DESCRIPTION OF THE INVENTION

Figure 4:
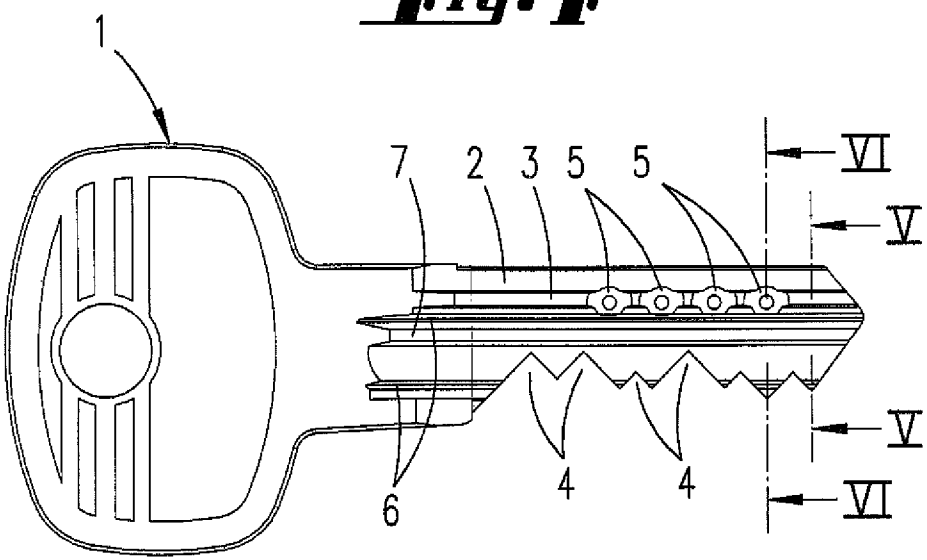
FIG. 4 shows a view onto the broad side of a key.
Figure 4:
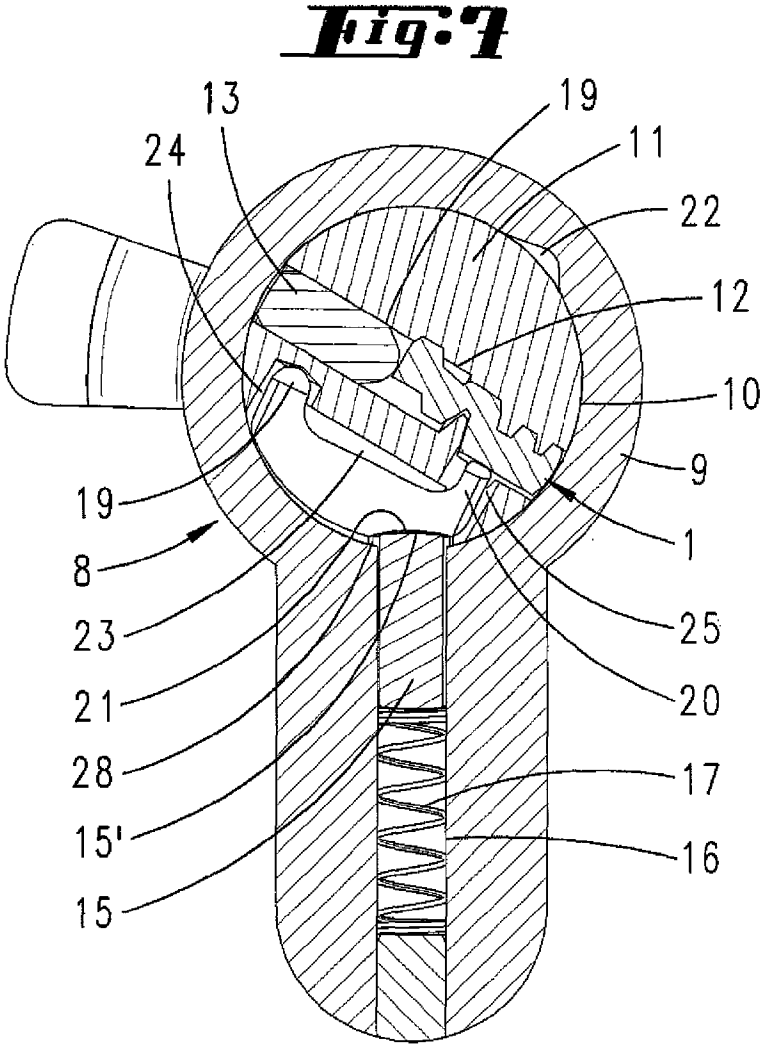
Figure 6:
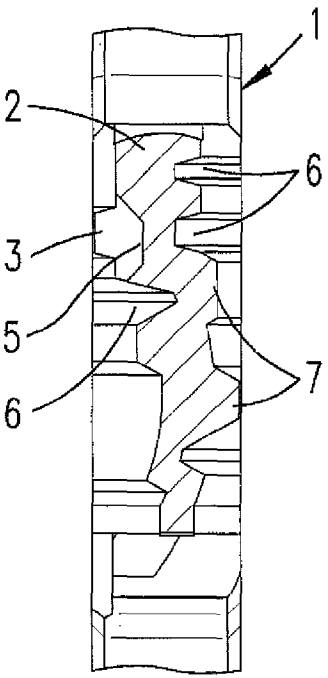
FIG. 6 shows a section on the line VI-VI.
Figure 5:
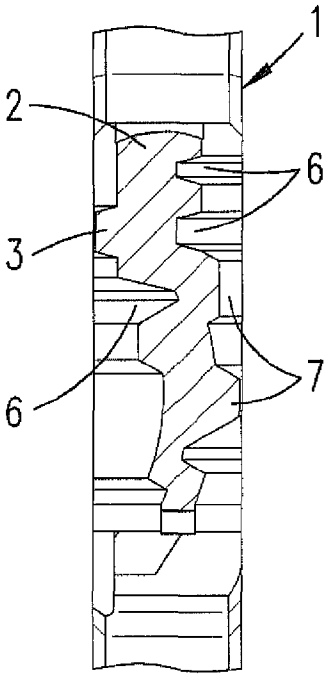
FIG. 5 shows a section on the line V-V.

The key illustrated in FIGS. 4 to 6 has a bow and a key bit 2 that extends from the bow of the key 1 and can be inserted into a keyway 12 of a cylinder core 11. The locking bit 2 has a narrow key spine and two broad side surfaces of the key that run substantially parallel to one another. The front of the key, opposite from the key spine, is provided with coding notches 4, these being cut-in on the edge.

On one broad side surface of the key bit 2, a blocking rib 3 runs in the direction of extent of the key bit 2, thus in the direction of insertion of the key 1. This blocking rib is directly adjacent the spine. The blocking rib 3 has a plurality of blocking rib indentations 5, which are formed by blind holes.

The broad sides of the key bit 2 have in addition also a plurality of profile grooves 6 and profile grooves 7, which run parallel to one another and parallel to the blocking rib 3.

The locking cylinder 8 has a housing 9, which carries a locking member at its middle. This locking member can be coupled to cylinder cores 11, which are located in bearing bores 10 that are directed away from one another.

Each of the two locking cylinder halves has housing holes 16 disposed in the flange region of the housing 9, in each of which holes there is a respective housing pin 15. The housing pin 15 is acted upon in the direction of the bearing bore 10 by a tumbler spring 17, which is supported on the base of the housing hole 16.

In the bearing bore 10, there is a cylinder core 11 that has a keyway 12 extending in the axial direction, the cross-sectional profile of the keyway corresponding to the cross-sectional profile of the key bit 2. The cylinder core 11 has a multiplicity of core holes 14 that extend in the radial direction and open into the keyway 12, a core pin 13 being provided in each core hole. The length of the core pins 13 defines the locking secret for the key and corresponds to the coding recesses 4 of the key bit 2.

In axial alignment with a core hole 14, the cylinder core 11 has an accommodating chamber 23, which is open towards the outer sleeve surface of the cylinder core 11. The accommodating chamber 23 provides a recess 24, which forms a bearing recess. This recess is located at one end of the accommodating chamber 23. The other end of the accommodating chamber 23 provides a through passageway 25 to the keyway 12.

A C-shaped pivot lever 18 is fitted in the accommodating chamber 23. The end of one C-limb of the pivot lever 18 forms a bearing end 19, which is mounted in the bearing recess 24 to be substantially only pivotable and not to be displaceable. The end of the other C-arm of the pivot lever 18 engages through the through passageway 25 and forms a sensing end 20 for the blocking rib 3. The back of the pivot lever 18 runs on an arcuate line, corresponding to the peripheral contour line of the cylinder core 11, and has an arcuate recess 21 which is near the sensing end 20 and has a recess base that runs in a gently arcuate shape. In this region, the accommodating chamber 23 is widened in the axial direction in such a way that it forms a capturing opening 28 for a housing pin 15. In the remaining region, the accommodating chamber 23 is configured to be narrower, so that there, the housing pin 15 cannot enter.

Figure 2:
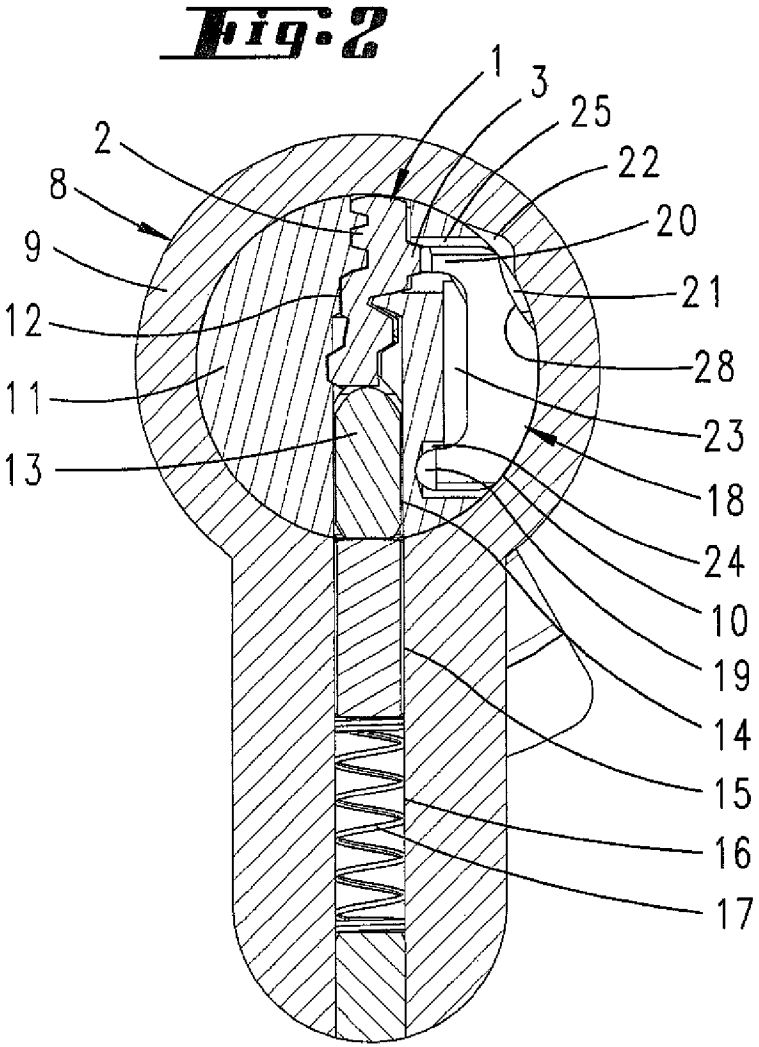
FIG. 2 shows a section on the line II-II through an accommodating chamber 23, in which a pivot lever 18 is fitted.

In the release position shown in FIG. 2, the pivot lever 18 is held, by being supported on the blocking rib 3, in a position in which the capturing opening 28 of the arcuate recess 21 is closed.

If the blocking rib 3 is missing, as is shown in FIG. 7, the capturing opening 28 is not closed by the back of the pivot lever 18. An end portion of the housing pin 15 that has an outwardly-curved end face 15' may, in this capturing position, enter the capturing opening 28. The housing pin 15 that has entered the capturing opening 28 thus blocks further rotation of the cylinder core 11. The rounding of the arcuate recess 21 substantially corresponds to the outward curvature of the end face 15'.

Figure 1:
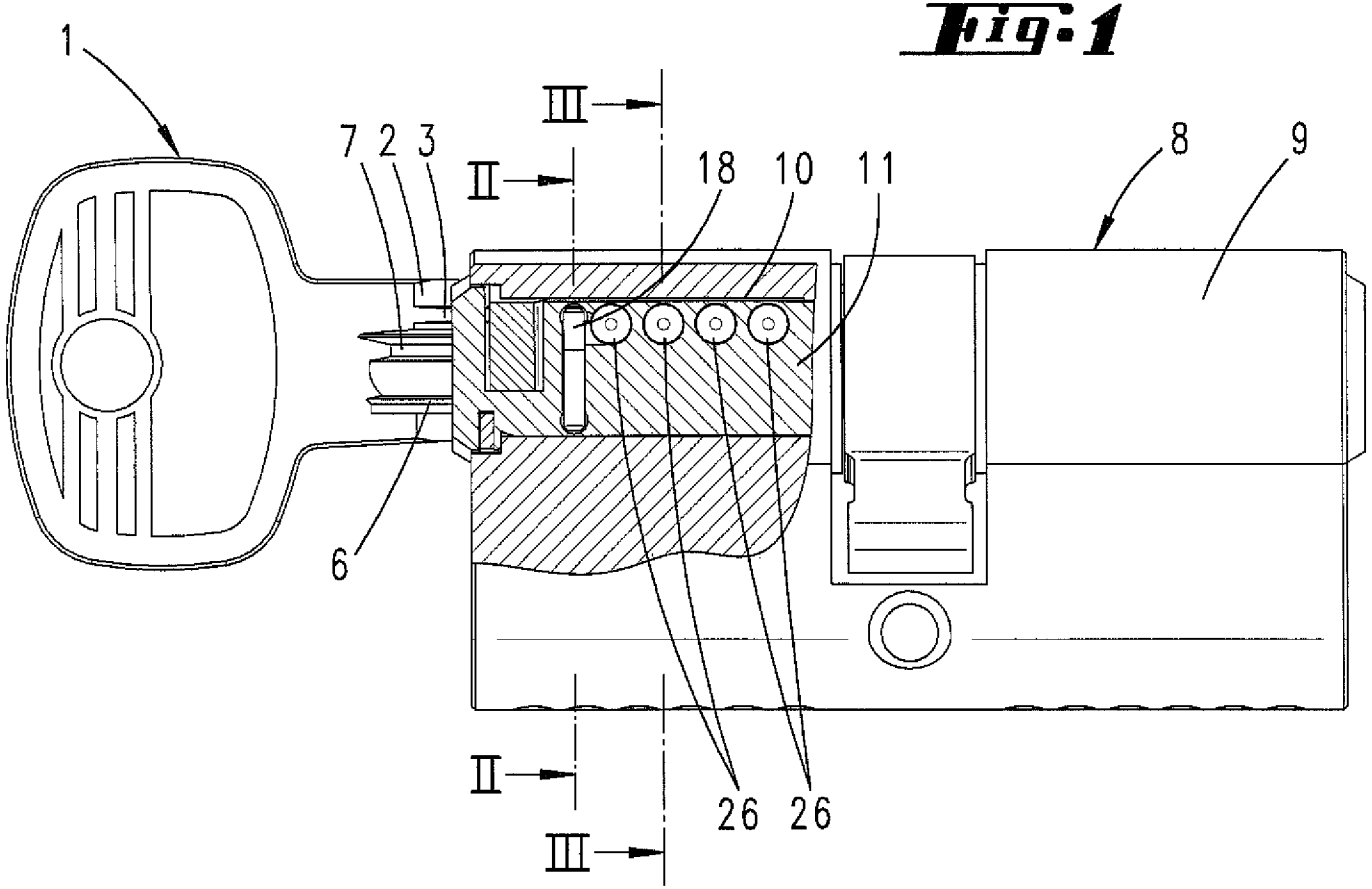
FIG. 1 shows in plan view, partially in section, a locking cylinder with key inserted.
Figure 3:
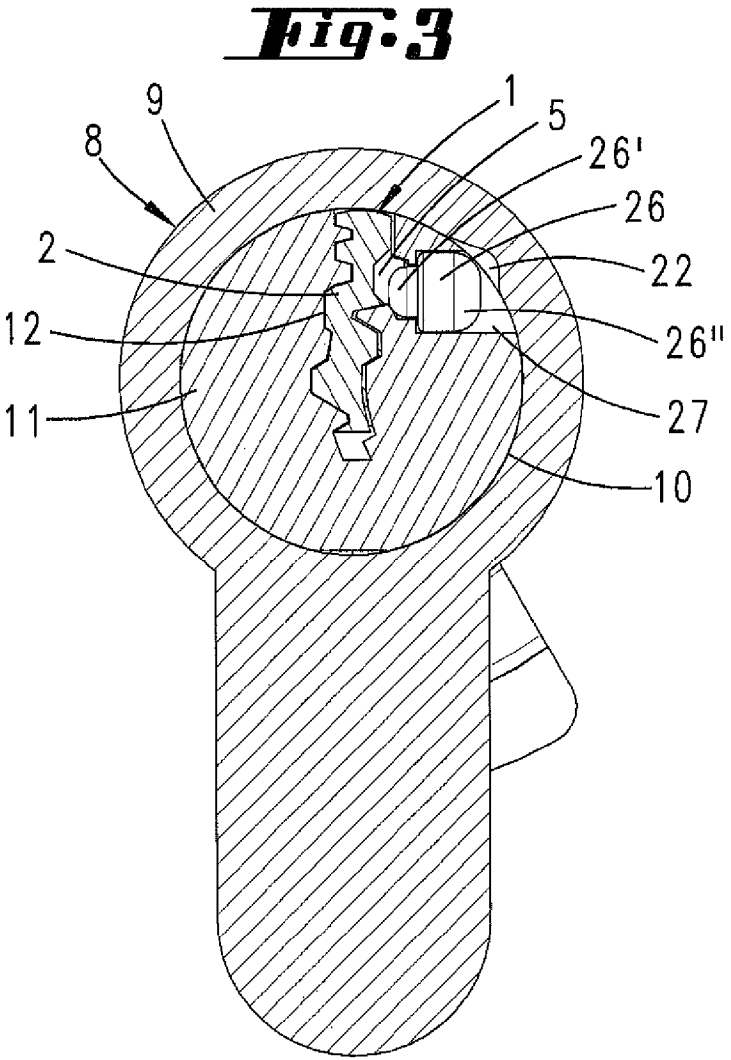
FIG. 3 shows a section on the line in FIG. 1 through a transverse hole 27 in the cylinder core 11, in which hole a blocking member 26 is mounted.

At least one of the blocking rib indentations 5 is sensed by a blocking member 26. This blocking member has a blocking end 26' of reduced diameter and a blocking end 26" of increased diameter. The blocking member 26 is mounted in a hole 27 that is transverse to the keyway 12. The transverse hole 27 is at approximately the same level as the arcuate recess 21. In the key withdrawal position (FIG. 3), the transverse hole 27 is aligned with a blocking recess 22, which can be formed by an axial groove in the wall of the bearing bore 10. If the sensing end 26' of the blocking member is located in a blocking rib indentation 5, the blocking end 26" is outside the blocking recess 22, so that if the coding recesses 4 are correct, the cylinder core 11 can be rotated. If the blocking rib indentation 5 is missing, the blocking member 26 is held by the blocking rib 3 with its blocking end 26" in the blocking recess 22, so that the cylinder core 11 is blocked against rotation.

If the blocking rib 3 is filed away, as is the case for the key illustrated in FIG. 7, the blocking members 26 cannot provide any blocking function. On account of the pivot lever 18 not being displaced into the release position, the housing pin 15 is however captured in the capturing opening 28 after a partial rotation of the cylinder core of between 90° and 100°. While the blocking members 26 formed by pins serve to sense the depth of hole indentations, the pivot lever 18 serves to sense the height of a blocking rib 3.

All features disclosed are (in themselves) pertinent to the invention. The disclosure content of the associated/accompanying priority documents (copy of the prior application) is also hereby incorporated in full in the disclosure of the application, including for the purpose of incorporating features of these documents in claims of the present application. The subsidiary claims characterize, in their optionally subordinated wording, independent inventive development of the prior art, in particular for the purpose of filing divisional applications based on these claims.

The invention claimed is:

1. A locking device, comprising:

a lock cylinder; and a matching key, the key having a key bit with at least one coding notch cut in on the front and a blocking rib that runs in a direction of extent of the key bit and has at least one blocking rib indentation, the lock cylinder having a housing with a bearing bore and a cylinder core that is mounted in the bearing bore and has a keyway for insertion of a key the cylinder core being blocked against rotation, when a key is not inserted, by at least one housing pin mounted in a housing hole, the housing pin projecting into a core hole of the cylinder core in which a core pin is fitted, and the housing pin being able to be brought into a release position enabling rotation of the cylinder core by entry of the core pin into the coding notch of the key inserted into the keyway, and the locking device having a blocking member for sensing the blocking rib indentation, the blocking member engaging, when a blocking rib indentation is not present, in a blocking recess of the bearing bore and preventing rotation of the cylinder core, wherein a pivot lever is mounted in the cylinder core and offset in an axial direction of the cylinder core relative to the blocking member, the blocking member being on a same side of the keyway as the pivot lever, the pivot lever having a bearing end about which the pivot lever is pivotable, and having a sensing end which senses the blocking ribin an indentation-free region of the blocking rib, the pivot lever closing off a capturing opening for the housing pin when the blocking rib is a proper height and opening the capturing opening for capturing the housing pin after a partial rotation of the cylinder core when the blocking rib is missing, wherein the pivot lever has a C-shape which is formed by C-limbs, an end of one of the C-limbs forming the bearing end and the end of the of the other C-limbs forming a sensing end, wherein a back portion of the pivot lever that is directed away from the C-limbs provides a recess for entry of an end face of the housing pin in a capturing position, the bearing end being substantially only pivotable.

2. The locking device according to claim 1, wherein the recess is rounded, the rounding of the recess being matched to an outward curvature of the end face of the housing pin, the back of the pivot lever having a convex curvature and the recess having a concave curvature.

3. The locking device according to claim 1, wherein a spacing of the C-limbs of the pivot lever is greater than a radius of the cylinder core.

4. The locking device according to claim 1, wherein the bearing end of the pivot lever is located in a recess-like indentation of an accommodating chamber in the cylinder core, a portion of the recess-like indentation being widened in an axial direction so as to form a capturing opening for the housing pin, and a remaining portion of the recess-like indentation is configured to be narrower so that the housing pin cannot enter.

5. The locking device according to claim 1, wherein the blocking recess is formed as an axial groove in a wall of the bearing bore.

6. The locking device according to claim 1, wherein the blocking member is formed as a pin.

7. The locking device according to claim 6, wherein the pin is a mushroom-headed pin.

* * * * *